US005101846A

United States Patent [19]

Greatwood

[11] Patent Number: 5,101,846

[45] Date of Patent: Apr. 7, 1992

[54] COVERED CRUTCH PAD

[76] Inventor: Y'vonne L. Greatwood, The Lewnsville, Apt. 403B, 1515 Great Falls St., McLean, Va. 22101

[21] Appl. No.: 513,843

[22] Filed: Apr. 24, 1990

[51] Int. Cl.[5] ..... A61H 03/02

[52] U.S. Cl. ..... 135/73; 2/66

[58] Field of Search ..... 135/73, 72, 71, 68; 383/4; 2/158, 65, 66, 175, 194

[56] References Cited

U.S. PATENT DOCUMENTS

| | | | |
|---|---|---|---|
| 246,827 | 9/1881 | Silberstein | 2/66 |
| D. 268,456 | 4/1983 | Oleniak et al. . | |
| 1,312,030 | 8/1919 | McGoldrick . | |
| 1,376,380 | 4/1921 | Pease . | |
| 1,485,374 | 3/1924 | Drueding | 2/158 X |
| 1,732,763 | 10/1929 | McKeag | 135/73 |
| 1,906,264 | 5/1933 | Higgins . | |
| 1,957,473 | 5/1934 | Pirtle et al. . | |
| 2,086,326 | 7/1937 | Goldberg | 2/66 |
| 2,391,263 | 12/1945 | Morton | 2/158 X |
| 2,442,896 | 6/1948 | Joseph . | |
| 3,150,672 | 9/1964 | Johnson, Jr. . | |
| 3,269,400 | 8/1966 | Smith et al. . | |
| 3,304,946 | 2/1967 | Lutes . | |
| 4,670,930 | 6/1987 | Lu | 2/158 X |
| 4,711,261 | 12/1987 | Rosenberg | 135/71 X |

FOREIGN PATENT DOCUMENTS

| | | | |
|---|---|---|---|
| 28580 | of 1911 | United Kingdom | 2/66 |
| 16851 | of 1915 | United Kingdom | 135/73 |
| 116761 | 6/1918 | United Kingdom | 135/73 |

*Primary Examiner*—David A. Scherbel
*Assistant Examiner*—Lan Mai
*Attorney, Agent, or Firm*—Dickstein, Shapiro & Morin

[57] ABSTRACT

An improved crutch pad for providing extended cushioning for a user's side for the crutch and crutch bar. The crutch pad utilizes an outer envelope formed from a flocked material, an inner padding envelope secured to the inside surface of the outer envelope and formed such that the underside of the inner padding envelope can be securely fit over the crutch. In a second; embodiment, a heat activated adhesive formed on the inner side of the inner padding envelope is used to secure the inner padding envelope to the crutch. The inner padding envelope also can be added to in order to customize the crutch pad to the needs of a particular user.

1 Claim, 8 Drawing Sheets

COVERED CRUTCH PAD

BACKGROUND OF THE INVENTION

The present invention relates to an easy to use crutch pad which is secured to a crutch to reduce arm, shoulder, underarm and rib cage pain from extended use of the crutch, and is provided in different sizes and is adaptable to utilize varying levels of padding, depending upon the needs of the individual user.

Known crutch pads provide padding only to the underarm crutch bar directly and not to the sides of the crutch. Since all the weight of the body is usually centered on the crutch bar, circulation is cut off, and pain develops from the pressure of the crutch. The user cannot avoid this problem by principally using his/her arms as support. This is because cushioning is only focused on the underarm, making it painful and difficult for the user to use his/her arms as the frame for walking. Examples of these types of pads are found in U.S. Pat. Nos. 1,312,030, 1,732,763, and 3,269,400.

Known crutch pad designs also are not adaptable to the individual needs of the user. Instead, they are mass-produced to be fitted over a standard crutch head. For those users who must place more weight on one crutch than the other, such pads do not provide adequate compensation. The end result may be injury to those parts of the body that rely more heavily on the crutch as support. Such a result could delay recovery by wearing the user down, and in some cases, forcing the patient to use a wheelchair permanently.

A need thereby exists for a crutch pad that provides adequate padding for all types of users, that is adaptable for a user's particular needs and that is affordable.

SUMMARY AND OBJECTS OF THE INVENTION

In view of the foregoing, it should be apparent that there exists a need in the art for a crutch pad that provides padding for the sides of a crutch. It is, therefore, a primary object of this invention to provide a pillow that adds padding to the top and particularly to the sides of a crutch in order to allow the user to use his/her full arm as a frame for the weight of the user's body thereby permitting extended use of the crutch.

More particularly, it is an object of this invention to provide a crutch pad which is attached to the crutch in a manner that prevents shifting or sliding of the crutch pad relative to the crutch and crutch bar and thus allows more comfortable, longer use and better control of the crutch.

An object of the present invention is to provide a crutch pad which is easily attached to and removed from a crutch, and yet, when attached, functions to prevent movement of the crutch pad relative to the crutch and thus allows more comfort, longer use and better control of the crutch and also reduces wear and tear on the user's underarm.

A further object of this invention is to provide a crutch pad with a flocked surface which provides for more comfortable use of the crutch.

A still further object of the present invention is to provide a crutch pad which allows the user to furnish different thicknesses of padding or add additional layers of padding in order to match the amount of padding needed to cushion the amount of weight placed on the crutch.

These and other objects of the invention are met by a crutch pad made from an inner pad and a flocked outer cover pad covering the inner pad. The inner pad forms inner plies which act as cushions covered by the outer cover pad. The crutch pad forms an oblong pillow which enfolds the crutch.

In an alternate embodiment, these objects of the invention are met by an inner envelope and an outer envelope formed from a flocked material, the inner and outer envelope can be slidably fit over the crutch and secured together, once placed over the crutch.

The present invention thereby provides an oblong shaped crutch covering which acts as a pillow against the upper arm to allow a user to use his/her arms as a frame in order to greatly reduce pressure on the underarm of the user.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
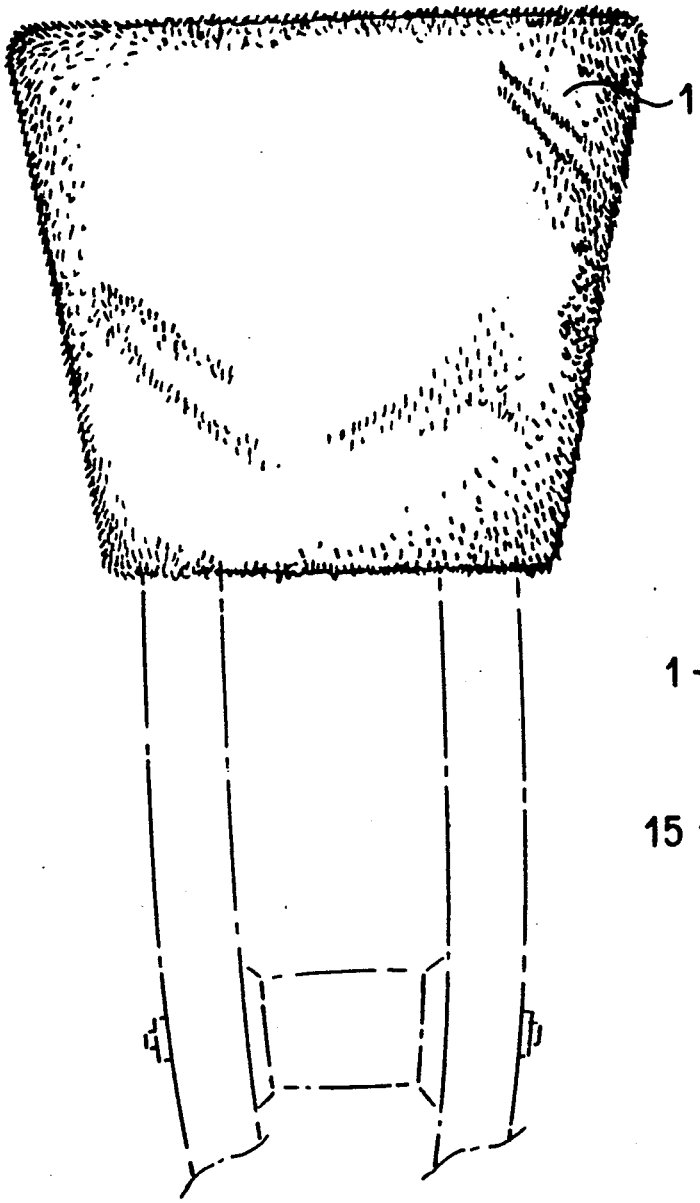
FIG. 1 is a front plan view of the crutch pad of the present invention secured to a crutch.

Referring now in detail to the drawings wherein like parts are designated by like reference numerals throughout, there is illustrated in FIG. 1 the outer appearance of the crutch pad 1. As shown in that Figure as well as in FIG. 3, the crutch pad 1 is constructed so that it covers the top crutch bar 7 of the crutch 8 as well as a crutch bar cushion 34 (shown by dotted line) in such a manner that it fits tightly over the crutch 8. Thus, the crutch pad 1 will not shift or move while in use.

Figure 3:
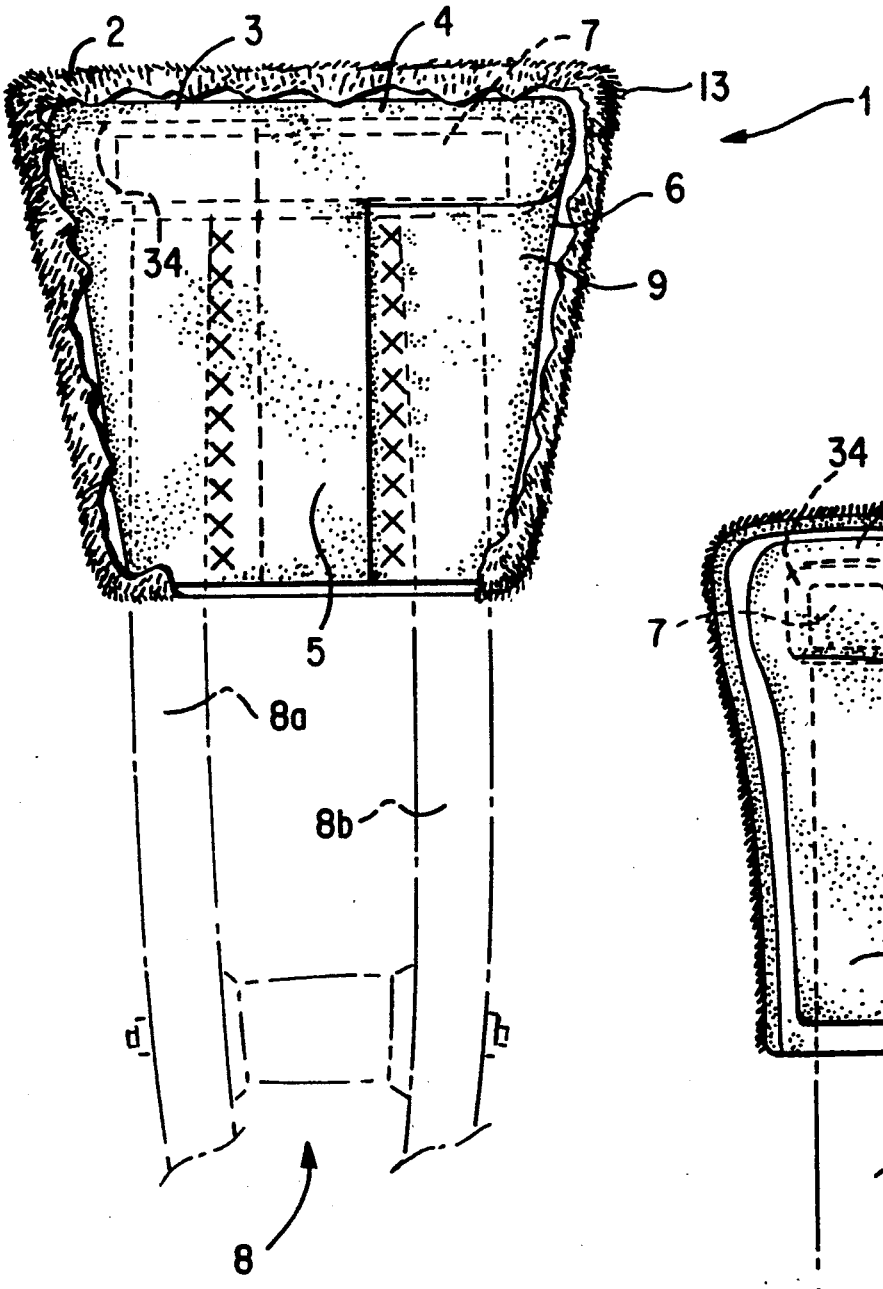
FIG. 3 is a front cut-away view of the crutch pad of the preferred embodiment of the present invention secured to a crutch.
Figure 4:
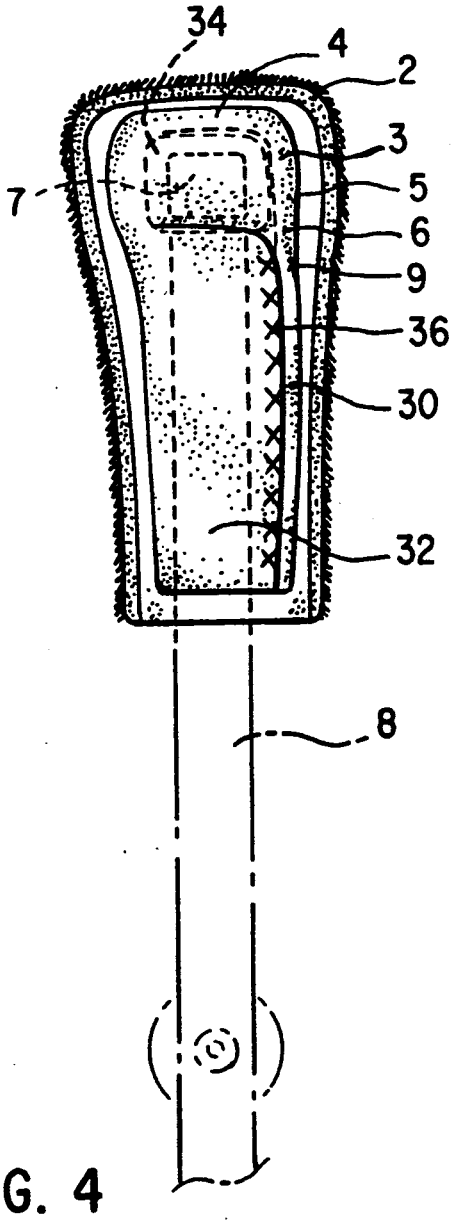
FIG. 4 is a side cross-sectional view of the preferred embodiment of the present invention secured to a crutch.

As shown in more detail in FIGS. 3 and 4, the crutch pad 1 is constructed from an outer pad 2 and an inner pad 3. The outer pad 2 may be made from a sheet having a flocked surface 13. An example of such material includes but is not limited to fake fur. However, it is known to those of ordinary skill in the art, that other materials may also be used, as long as the dimensions allow for the crutch pad 1 to fit tightly over the top of crutch bar 7 and cushion 34.

Figure 2:
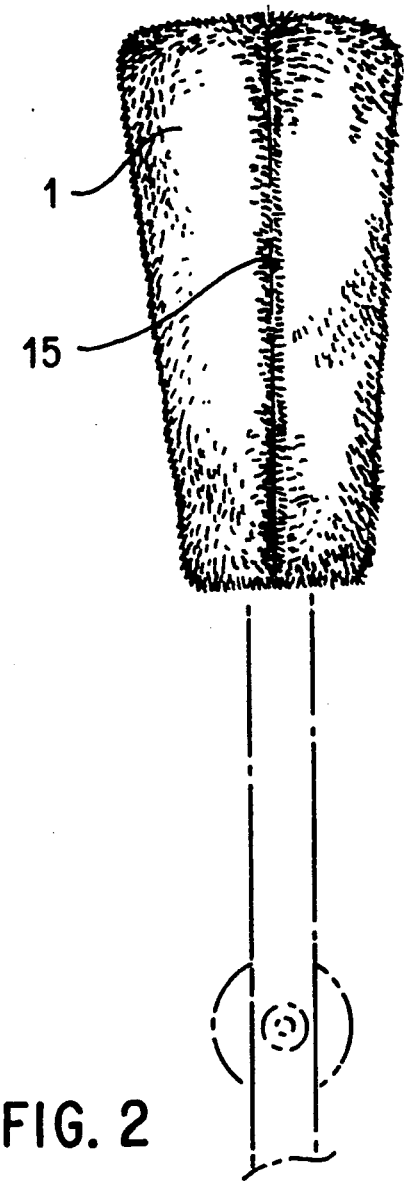
FIG. 2 is a side plan view of the crutch pad of the present invention secured to a crutch.
Figure 8:
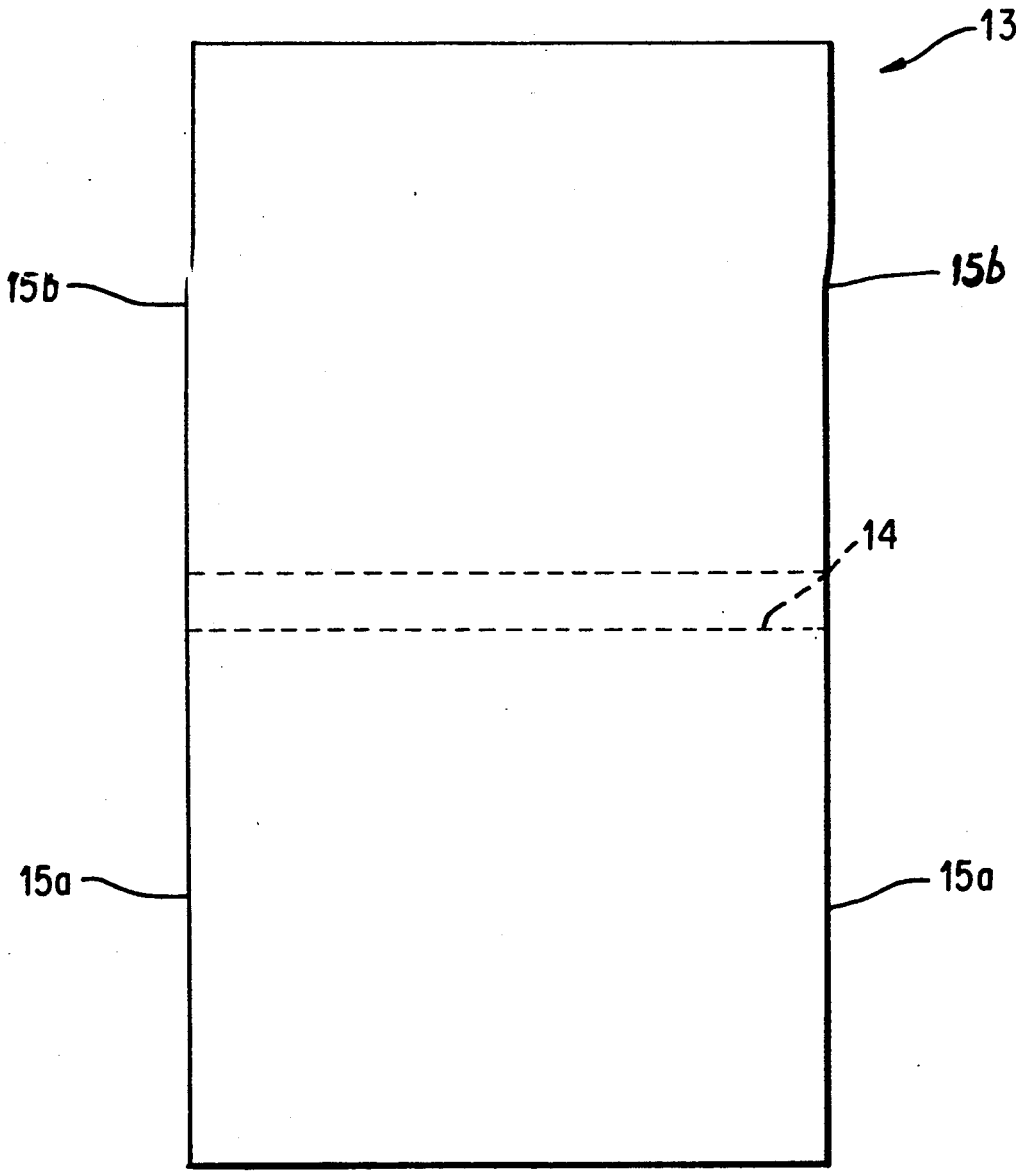
FIG. 8 is a top view of the unfolded cover sheet which is used to form the outer envelope of the crutch pad of the present invention.
Figure 9:
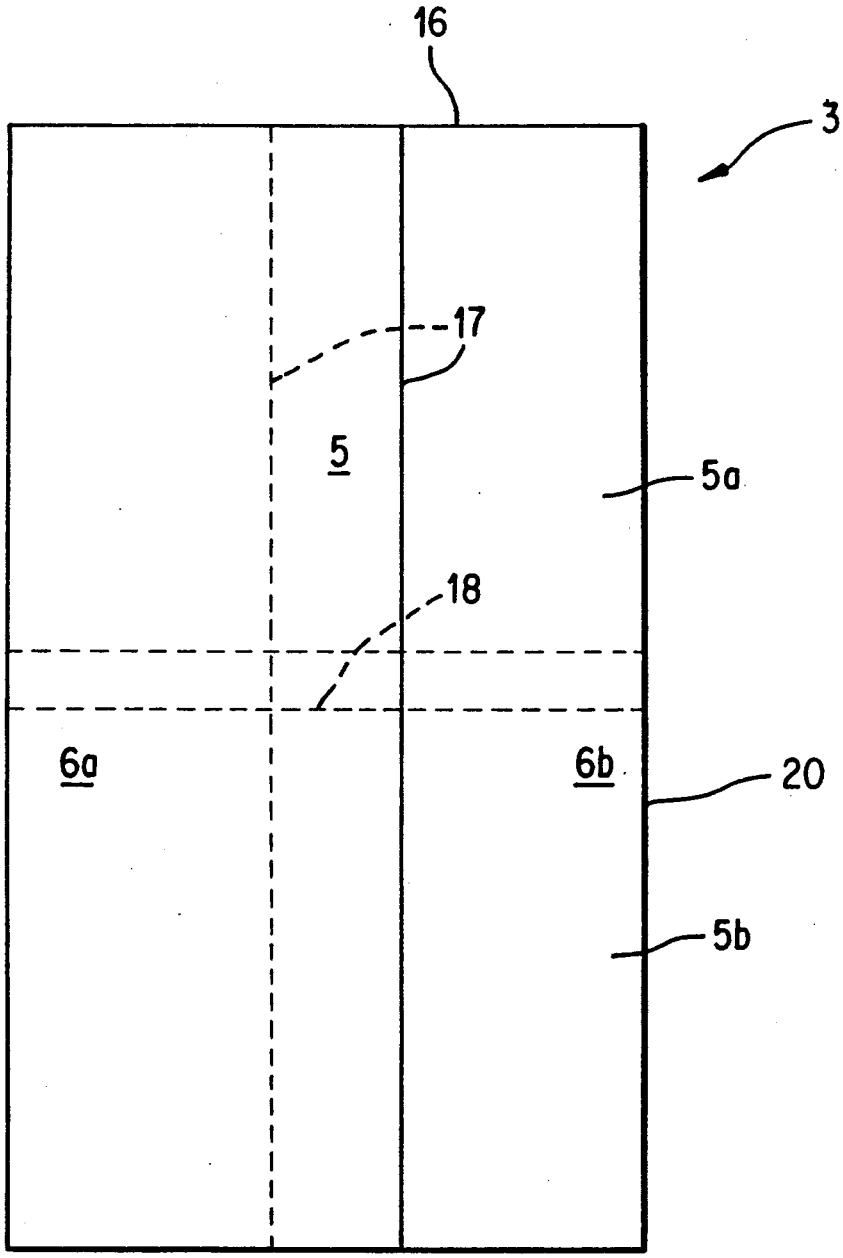
FIG. 9 is a top view of the folded inner padding sheet which is used to form the crutch pad of the present invention.

As shown in FIGS. 2 and 8, in order to form the outer envelope 2, the sheet of flocked material 13 is folded at the cover center fold-line 14 and may be glued and/or stitched together at the side seams 15*a* and 15*b*. The folded inner padding 3, as shown in FIG. 9, may be made from an inner padding sheet 16, which may be formed from a sheet of polyfill material. However, any padding material having substantially similar characteristics to polyfill and known to those skilled in the art may be employed. In order to form the inner padding envelope 3, the inner padding sheet 16 is first folded along a side fold-line 20 to form a double thickness. The sheet's sides are then folded over toward one another to form side edges 17 and then along the inner padding center fold-line 18. When assembled on the crutch, as discussed below, the fold edges 17 are sewn together such that the pad has a triple thickness at its longitudinal center 5 and a double thickness along the folded sides 6*a* and 6*b*. The location of the center fold line 18 corresponds to the fold line 14 for the outer envelope (See FIG. 8).

The construction of the inner and outer pads, as assembled on the crutch, are shown in more detail in the cross-section side view of FIG. 4. The inner pad 3 has a top portion 4, a folded side portion 6. The outer portion 30 of the inner pad 3 is folded against an inner portion 32 such that a double pad is formed along one side of the crutch 8. This is accomplished by wrapping the inner portion 32 around cushion 34 in order to overlap inner portion 32 with outer portion 30. The outer and inner portions 30 and 32 are then sewn together along stitch line 36. The outer pad 2 is then folded over inner pad 3 and the sides are then stitched.

The inner and outer side portions 30, 32 of the inner pad 3 function to cushion the side portions of the crutch 8, along the legs 8*a*, 8*b* (FIG. 3) as well as the crutch bar 7.

The bottom of the inner pad sides are then turned in and stitched along with the outer pad. As a result, the pad is secured together so that it cannot easily shift on the crutch.

Figure 5:
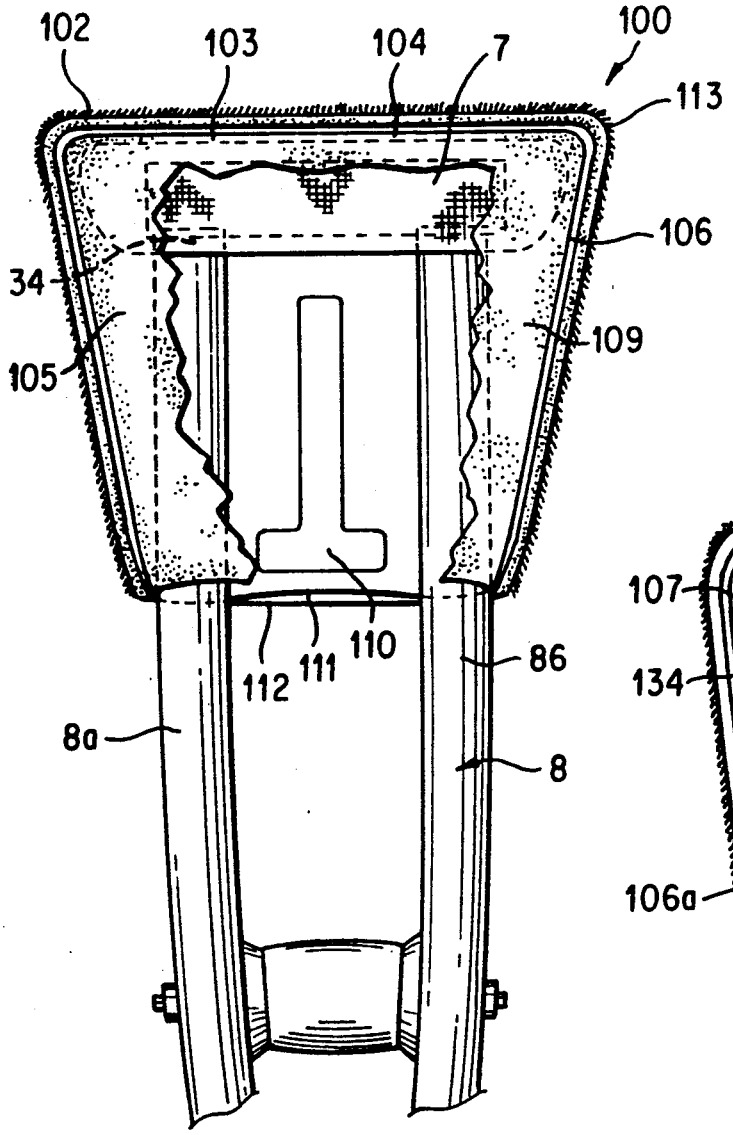
FIG. 5 is a front cut-away view of a second embodiment of the crutch pad of the present invention secured to a crutch.
Figure 6:
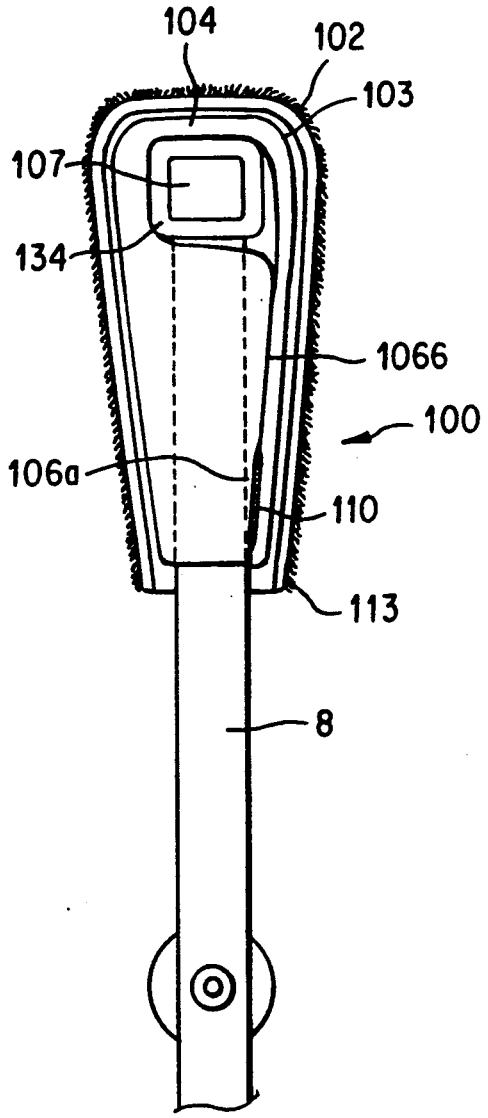
FIG. 6 is a side cross-sectional view of the second embodiment of the present invention.

The construction of the second embodiment 100 is shown in FIGS. 5 and 6. More particularly, the inner and outer envelopes of the second embodiment are shown in cross-section in FIG. 6. The inner padding envelope 103 has a top portion 104, and folded side portions 106*a*, 106*b*. The outer side of the inner padding envelope 103 is adhesively attached to the inner side of the outer envelope 102. The inner side of the inner padding envelope 103 fits slidably over the crutch bar 7 and crutch bar 134 at the top portion 105 of the inner padding envelopes 103, thereby providing a cushion to both the top and sides of the crutch 8.

The enfolded side portions 105, 106 of the inner padding envelope 103 (FIG. 5) function to cushion the side portions of the crutch bar 7 as well as the legs 8*a* and 8*b* of the crutch 8.

As shown in FIG. 5, an adhesive layer 110 formed in an inverted "T" resides on the inner surfaces of the inner padding envelope 103 in such a manner as to assist in securing the crutch pad to the crutch 8. The bottom of the inverted T adheres the bottom seams 111 of the inner padding envelope 103 together. As a result, the adhesive layer 10 functions to partially seal the bottom seam 111 as well as secure the crutch pad 100 to the crutch by attaching one inner side 106*a* (FIG. 6) of the inner padding envelope 103 to the other inner side 106*b* of the envelope 103, after it has been folded.

The adhesive 110 is preferably heat-activated so that it forms a seal when heat is applied to it. However, other types of adhesive material may be utilized with this invention. For example, a hot melt adhesive covered by a peelable paper liner may be employed. Other types of fasteners may be substituted for the adhesive layer 10, such as plastic fasteners, velcro or tapes.

Figure 7:
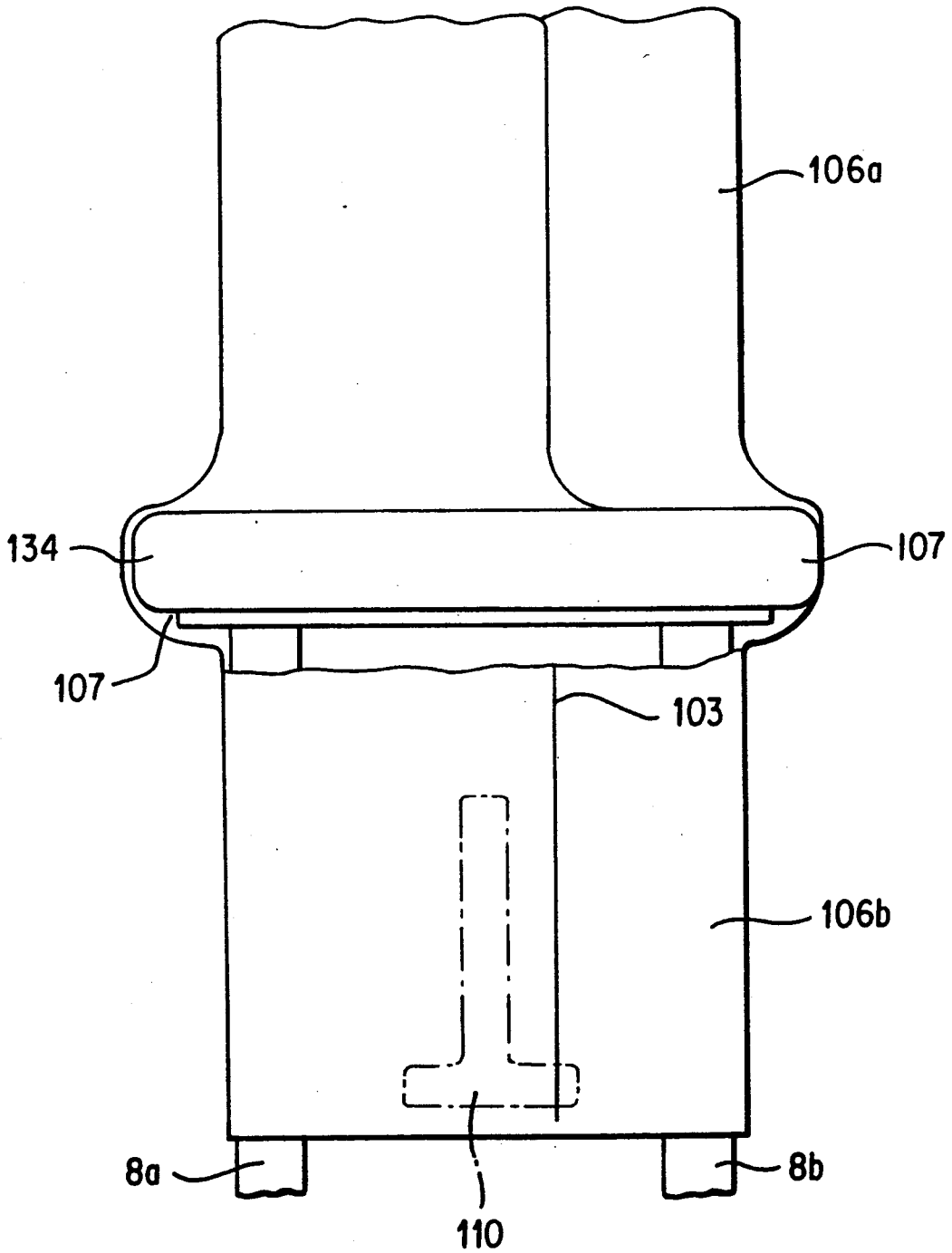
FIG. 7 is a front exploded view of the unfolded inner padding envelope of the second embodiment partially mounted on a crutch.

As shown in FIG. 7, the crutch pad 100 of the present invention is designed so that the purchaser may easily attach and remove it from the crutch 8. In order to attach the inner padding envelope 103 to the crutch 8, the user first places the crutch 103 over crutch bar 107 and crutch bar cushion 134 so that a lower portion 106*b* fits snugly over the crutches. An unsewn area of the inner padding fits over the crutch bar 107 and crutch bar cushion 134. The top portion 106*a* of the inner padding envelope is then folded over crutch bar 107 towards inner pad 106.

The second step involves attaching folded portion 106*a* to portion 106*b*. This involves application of a hot iron or other heat source (for example, a hair dryer) to the outer surface of the inner pad 103 over the T-shaped adhesive layer 106*a* and 106*b* of the inner padding 103. As a result, the adhesive layer 110 secures the inner pad 103 to the crutch 8*b* and also secures inner sides 106*a* and 106*b* together so that the inner pad 103 cannot move any substantial distance when in use.

Figure 10:
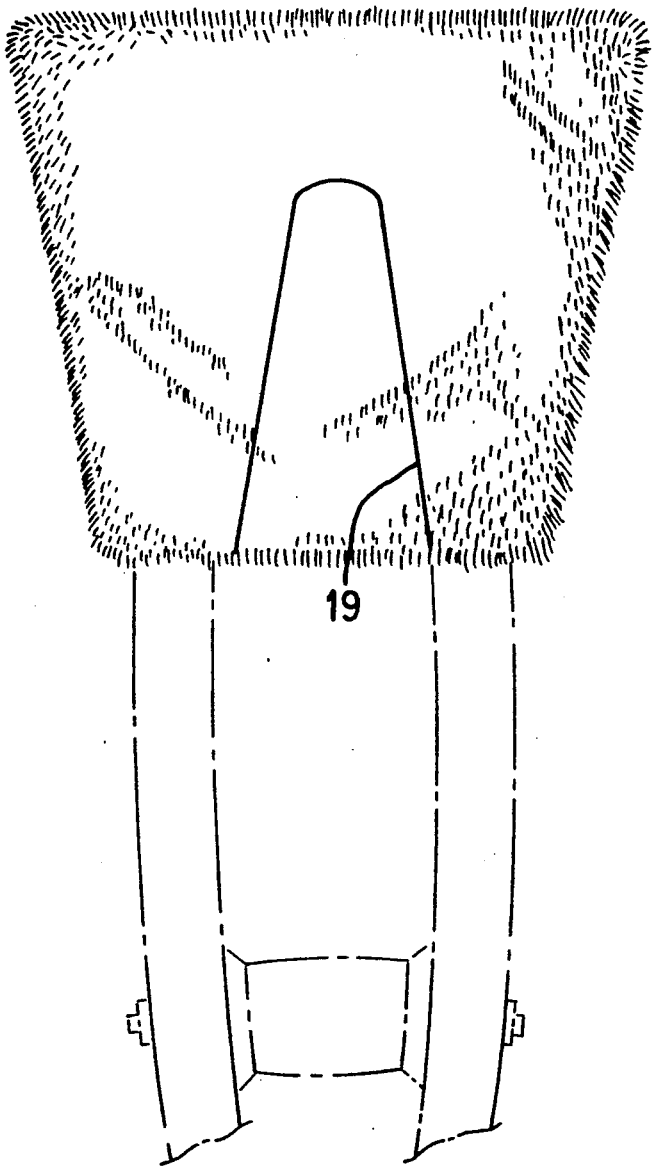
FIG. 10 is a front view of the crutch pad of the present invention secured to a crutch and showing a cut line.

When the user wishes to remove the crutch pad 1 or 100 from the crutch 8, the user cuts the crutch pad 1 either around the T-shaped adhesive layer 110 along the cut line 19, or through the threads as shown in FIG. 10.

The user also may customize the crutch pad 1 or 100 of the present invention by adding material to or changing the type of material of the inner pad. For example, a light weight thin pad, such as that marketed as Mountain Mist, can be used for children. A regular weight pad may be used for women, and a thick blanket weight pad for adult males.

Figure 11:
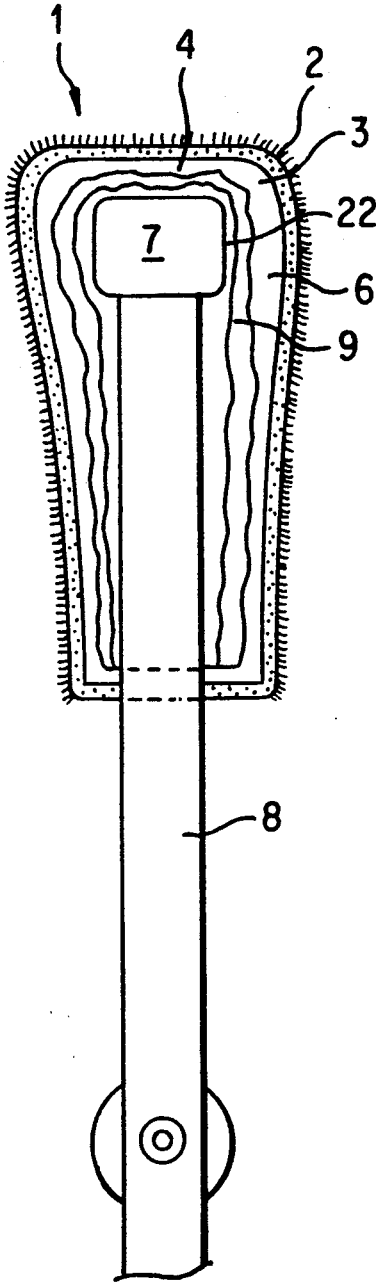
FIG. 11 is a side cross-sectional view of a third embodiment of the present invention secured to a crutch.

Alternatively, as shown in FIG. 11, the crutch pad can be customized by adding a second inner pad 22 of similar construction to that of the first inner pad 3 to the crutch pad 1. The second inner pad 22 is then either sewn, or adhered or attached in any conventionally known manner. The result is a crutch pad having a three fold thickness of padding to compensate for added wear.

The crutch pad 1 of the present invention is easily constructed by the user and, in the alternative embodiment, can be readily manufactured. In order to construct the outer pad 2, the user or manufacturer cuts a sheet 13 of flocked fabric (FIG. 8) having an unflocked side facing out. The dimensions of the cut can vary depending upon the size of the user (for example, a pad for a female could be cut 23" by 14"). The unflocked side of the sheet 13, which forms the outer envelope 2, is then folded at the center fold line 14 so that the unflocked side of the sheet 13 still faces outwards. The next step in the manufacturing process involves the connection of the side seams 15*a* to the side seams 15*b* in order to form the outer envelope 2. The side seams 15*a* and 15*b* may be secured to each other by basting side 15*a* to 15*b* with the unflocked sides facing out, and then turning the envelope inside out. The outer pad (not shown) is then placed over the inner pad. The outer pad can be attached to the inner pad in the same manner as the folded portions of the inner pad 103 as previously described with reference to FIG. 7. The outer envelope 2 is then turned inside-out so that the flocked material faces outwards.

As shown in FIG. 9, in order to construct the inner pad from a similar sized piece of material as the outer pad shown in FIG. 8, the inner padding material is cut to form inner pad sheet 16. Again, the size of the inner pad sheet differs depending on the size of the individual using the crutch. Usually a double thickness pad is formed by overlapping sides 6 along center area 5. The folded portions 6 of the respective inner sides 5*a* and 5*b* of the inner padding envelope 3 are then folded together as shown in detail in FIG. 7. Finally, the manufacturer secures the outer side of the inner padding envelope 3 to the inner side of the outer envelope 2, using, for example, slip stitches or suitable fasteners.

As will be obvious to those of ordinary skill in the art, the crutch pad 1 could also be secured to the crutch bar 7 and cushion 34 and to the crutch 8 by means of stitches in a T-shaped pattern, rather than by the adhesive layer 110 formed in an inverted T-shaped pattern. Other modifications will also come to mind to those of ordinary skill in the art.

Although only two preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A method for constructing a covered crutch pad with a flocked outer surface, said method comprising the steps of:

cutting a flocked material into a sheet, said sheet having a first side and a second side;

folding the sheet at a center fold-line so that said first side faces outwards to form an outer envelope with side seams;

securing the side seams of said outer envelope together;

forming a cover for said crutch pad by turning said outer envelope inside out so that said second side of said outer envelope faces outwards;

cutting a double-thickness inner pad into an inner padding sheet;

folding a first end of said inner padding sheet along its side and center folding liens to form an inner padding pillow, folding a second end of said inner padding sheet over said first end, and attaching said first end of said inner padding sheet to said second end of said inner padding sheet, to form a pillow having a greater thickness along one side of a crutch; and fastening said cover and said pillow together to form said crutch pad with said flocked outer surface, whereby said crutch pad is arranged to be secured tightly to said crutch.

* * * * *